US010331160B2

(12) United States Patent
Clauss et al.

(10) Patent No.: US 10,331,160 B2
(45) Date of Patent: Jun. 25, 2019

(54) OPERATOR CONTROL ELEMENT AND DOMESTIC APPLIANCE

(75) Inventors: Stéphane Clauss, Stotzheim (FR); Martin Oberhomburg, Wetter (DE)

(73) Assignee: BSH Hausgeräte GmbH, Munich (DE)

( * ) Notice: Subject to any disclaimer, the term of this patent is extended or adjusted under 35 U.S.C. 154(b) by 1132 days.

(21) Appl. No.: 14/007,728

(22) PCT Filed: Apr. 3, 2012

(86) PCT No.: PCT/EP2012/056031

§ 371 (c)(1),
(2), (4) Date: Sep. 26, 2013

(87) PCT Pub. No.: WO2012/139926

PCT Pub. Date: Oct. 18, 2012

(65) Prior Publication Data

US 2014/0013897 A1 Jan. 16, 2014

(30) Foreign Application Priority Data

Apr. 11, 2011 (EP) ..... 11290185

(51) Int. Cl.
*G05G 1/10* (2006.01)
*F24C 3/12* (2006.01)

(52) U.S. Cl.
CPC ..... *G05G 1/10* (2013.01); *F24C 3/126* (2013.01); *Y10T 74/2084* (2015.01)

(58) Field of Classification Search
CPC ..... G05G 1/10
USPC ..... 74/553; 126/39 R
See application file for complete search history.

(56) References Cited

U.S. PATENT DOCUMENTS

| | | | | |
|---|---|---|---|---|
| 2,748,099 | A * | 5/1956 | Bruner et al. | 524/439 |
| 3,910,852 | A * | 10/1975 | Lederman et al. | 252/512 |
| 2007/0051140 | A1 | 3/2007 | Schuck et al. | |
| 2010/0063191 | A1* | 3/2010 | Hirono | 524/284 |
| 2011/0203571 | A1* | 8/2011 | Schnetzer et al. | 126/39 R |

FOREIGN PATENT DOCUMENTS

| | | | | |
|---|---|---|---|---|
| EP | 211185 | A * | 2/1987 | |
| JP | H11288322 | A | 10/1999 | |
| WO | 2009000713 | A1 | 12/2008 | |
| WO | WO 2010053226 | A1 * | 5/2010 | C08K 3/08 |

OTHER PUBLICATIONS

International Search Report PCT/EP2012/056031 dated Aug. 23, 2012.
Report of Examination CN 201280017857.3 dated Aug. 1, 2016.

* cited by examiner

*Primary Examiner* — Vicky A Johnson
(74) *Attorney, Agent, or Firm* — Michael E. Tschupp; Andre Pallapies; Brandon G. Braun

(57) ABSTRACT

An operating element for a domestic appliance includes a main body which is made of a material comprised of plastic and a filler admixed to the plastic. The filler has a thermal conductivity which is higher than a thermal conductivity of the plastic. The filler can be present in particle form, e.g. as spheres, grains, fibers or as powder.

8 Claims, 1 Drawing Sheet

OPERATOR CONTROL ELEMENT AND DOMESTIC APPLIANCE

BACKGROUND OF THE INVENTION

The invention relates to an operating element for domestic appliances, in particular an operating knob for a thermal domestic appliance. The invention also relates to a domestic appliance having at least one operating knob.

Operating elements, such as operating knobs for example, are used on many domestic appliances to set outputs or functions. Plastic knobs are often used for cost reasons or because of external physical stress. However these do not convey the high-quality sensation of metal knobs.

It is known that plastic knobs can be coated with metal. This has the advantage that the visual impression of the knob is very good. It has the disadvantage that the feel sensation still corresponds to the feel sensation of plastic. The generally very thin metal layer is not sufficient to convey a good metal sensation to the user. A metal sensation here refers to the sensation the user experiences when touching a metal object. In particular a metal object generally feels cold or cool to the user, even if the object is at room temperature for example.

It has also been proposed that a metal weight should be integrated in a plastic knob, the metal weight being enclosed by the plastic knob. This variant produces a high-quality touch sensation but has the disadvantage that the knob weight is only perceptible when the knob is pulled out and has a sufficiently large diameter.

Knobs made of aluminum/zinc alloys (Al—Zn alloy), in particular Zamak, are also known. Such knobs have the advantage that they convey a very good metal sensation. However they cannot be used in many appliances because of their low permissible temperature limit.

BRIEF SUMMARY OF THE INVENTION

The object of the present invention is therefore to create a plastic operating element, in particular a plastic operating knob, which gives the user the sensation of a metal knob both in respect of visual impression and feel.

The invention is based on the knowledge that said object can be achieved by using a filled plastic as the material for the operating element.

According to the present invention said object is therefore achieved by an operating element for a domestic appliance, the operating element having a main body made of plastic. The operating element is characterized in that the plastic is admixed with filler, which has a higher thermal conductivity than the plastic.

In the context of the invention an operating element refers to an element, by way of which functions and outputs of the domestic appliance can be controlled or set by the user. The operating element here is preferably a mechanical operating element, for example a switch or knob. In this context a mechanical operating element refers to an operating element that is actuated mechanically by the user. Further functions of the operating element can however be executed electrically or otherwise. Within the context of the present invention a domestic appliance refers in particular to heat-conducting domestic appliances such as ovens, cookers and cooktops. The inventive operating element can however also be used with large white goods-type appliances, for example refrigerators, upright freezers, chest freezers, electric cookers, washing machines, dishwashers, extractor hoods and tumble dryers. Finally the inventive operating element can also be used on small appliances, for example a toaster.

According to the invention the main body of the operating element refers to the part of the operating element to which the user applies force to actuate the operating element. In particular therefore the main body represents the part of the operating element which is touched or gripped by the user. If the main body is coated, touching or gripping is indirect, in other words by way of the coating.

According to the invention the plastic is admixed with filler, which has a higher thermal conductivity than the plastic. The plastic is preferably a polymer. The plastic admixed with filler here refers to a plastic in which filler is held or incorporated in a plastic matrix. The plastic is thus interspersed with the filler. The filler is preferably distributed in a regular manner in the plastic or plastic matrix. In the context of the invention thermal conductivity refers in particular to specific thermal conductivity (X). Although the singular is used in the description of filler, it is evident that it can consist of a number of components and even different materials.

Because filler with a higher thermal conductivity than the plastic is provided in the main body, the operating element can be produced at low cost. Raising the thermal conductivity of the main body by adding the filler also produces a metal sensation when the operating element is touched. The present invention in particular makes use of the fact that the feel sensation of metal knobs is mainly due to high thermal conductivity. When a metal knob is handled at ambient temperatures, it feels cold, as the ambient temperature (~20° C.) is colder than the skin of the finger (>30° C.) and there is a rapid transfer of heat between the knob and the finger which produces a cold sensation. This sensation, which can also be referred to as cool touch, can only be achieved with high thermal conductivity. The thermal conductivity of aluminum is for example around ~200 W/mK and for conventional plastics it is only around 0.2-0.3 W/mK. A plastic knob can therefore not produce a cool touch but the inventive operating knob allows such a cool touch to be produced.

As the filler is also provided in the plastic, in other words distributed therein, there is no risk of damage due to mechanical stress, which can occur with a simple coating. Also the material thickness of the main body is generally greater compared with a coating so heat can be transferred over a greater distance in the material. The use of a filled plastic is also advantageous as the filler is distributed in the plastic matrix and therefore contact between the skin of the user and the filler is ensured at the surface, which is touched by the user—in some instances through a coating. This ensures a transfer of heat, as required to produce a metal sensation. Finally the provision of filler with higher thermal conductivity is advantageous as it can be added in a specific manner based on thermal and mechanical requirements, allowing the operating element to be modified according to its intended use. In particular the composition and quantity of the filler can be varied. It is thus possible for example to take into account the normal operating temperature of the domestic appliance in the region of the operating element.

The filler is preferably present in particle form in the plastic of the main body. In particular the filler can be present as spheres, grains, fibers and/or powder. Compared with chemically treated plastics, in which added substances are chemically bound, with the inventively preferred form of the filler as particles it is possible to set the desired thermal conductivity of the material of the main body more simply and reliably.

The material of the filler can be selected from a plurality of materials, as long as the thermal conductivity of the material is higher than the thermal conductivity of the plastic in which the filler is incorporated. According to the invention it is particularly preferable for metal fillers, in particular powdered copper, powdered aluminum or powdered stainless steel to be used. The advantage of metal fillers is in particular their low purchase costs and their mechanical strength. Metal fillers and in particular copper, for example in powder form, are also advantageous as they and in particular a plastic admixed or filled with them can also be galvanically coated with materials such as chromium or nickel. Copper also has a thermal conductivity of 400 W/mK and therefore even quite small quantities of filler are sufficient to achieve a desired thermal conductivity of the material of the main body of the operating element.

It is also within the scope of the invention, additionally or alternatively, to use ceramic fillers and/or glass fillers, such as glass spheres, and/or carbon fillers, for example graphite or diamond. Further possible fillers include aluminum nitride or boron nitride.

The material of the main body preferably has a thermal conductivity of 0.5 to 30 W/mK, preferably 1 to 20 W/mK. The plastic with the filler held or incorporated therein is referred to as the material of the main body. The thermal conductivity can be set by selecting the material of the fillers and their quantities accordingly. The thermal conductivity of the material of the main body is preferably higher than that of a purely plastic main body but much lower than that of purely metal main bodies. One advantage of this mid-range thermal conductivity is that the operating element can also be used with domestic appliances in which the operating temperature is high in the region of the operating element. Such domestic appliances are for example gas cooktops, which can be integrated in cookers or can be present as a separate domestic appliance. The relatively low thermal conductivity compared with metal main bodies excludes the possibility of injury to the user, in particular burning. On the other hand the touch sensation with this preferred thermal conductivity is closer to that of a metal main body than with a main body made purely of plastic. The inventively achievable mid-range thermal conductivity of the material of the main body of the inventive operating element means that it can be up to 100 times more thermally conducting than unfilled plastic.

According to one embodiment the proportion by volume of filler in the material of the main body is less than 70%, preferably less than 50%. This quantity of filler has been demonstrated to be advantageous particularly with fillers that contain copper or are made of copper. Such a quantity of filler allows the properties of the matrix material of the main body, in other words the plastic, and those of the filler to be combined in an optimum manner.

The plastic of the main body is preferably a thermoplastic plastic. According to one preferred embodiment the plastic of the main body, which is admixed with the fillers, comprises technical polymers, in particular polyamides.

Technical polymers include inter alia the following polymers. Polyamides, (PA), ABS (acrylonitrile butadiene styrene) which can be admixed with copolymer carbonates and is suitable for coating, in particular with metal coatings. Further examples of technical polyamides are PBT (polybutylene terephthalate, polycarbonates (PC), polyoxymethylene (POM), polypropylene (PP), polystyrene (PS) and the like.

According to the invention polyamides are preferred. It has been demonstrated that polyamides containing fillers according to the present invention, in particular powdered copper, are suitable for coating, in particular with metal coatings.

According to one embodiment of the operating element the main body of the operating element is coated. The coating here is preferably a metal coating. Because the main body is made of a plastic containing a filler with higher thermal conductivity, the metal coating is no longer solely responsible for conveying a metal sensation when the operating element is touched. The thickness of the coating can therefore be minimized. The coating preferably has a thickness of less than 0.1 mm. The coating can be for example a galvanic coating with nickel or chromium. The metal coating also improves the visual impression of the control element and in particular produces a metallic appearance.

The operating element is preferably an operating knob. An operating knob refers to an operating element which is generally actuated by rotational movement and optionally also by axial movement. During a rotational movement the user is in contact with the operating element for quite a long time, so the advantages of the inventive operating element are particularly significant here.

The inventive operating element can be an injection molded part. The use of plastic as the matrix material for the main body allows even complex operating element shapes to be produced in a simple manner by injection molding. The injection molding of thermally conductive plastics, in particular the inventively used plastics containing fillers, is different from the injection molding of the pure polymer matrix. Filling the plastic with particles and raising the thermal conductivity of the plastic mass accelerates the transfer of thermal energy from the plastic to the colder tool. The filled polymer sets more quickly in the edge region, narrowing flow paths and cavities. Therefore during the production of an inventive operating element process management and process parameters are tailored to these changed material properties like the tool. In particular injection speed and injection pressure are preferably increased as well as tool temperature compared with processes with pure plastic.

According to a further aspect the invention relates to a domestic appliance having at least one operating element, at least one of the operating elements being an inventive operating element. In particular the operating element has a main body made of plastic, the plastic being admixed with filler which has a higher thermal conductivity than the plastic.

According to one preferred embodiment the domestic appliance is a cooktop, in particular a gas cooktop. The advantages of the present invention, in particular the settable or set thermal conductivity of the operating element, are particularly significant with this type of domestic appliance.

Advantages and features described in relation to the inventive operating element apply correspondingly—where applicable—to the inventive domestic appliance and vice versa.

BRIEF DESCRIPTION OF THE DRAWINGS

The invention is described again below with reference to the accompanying drawings, in which.

DETAILED DESCRIPTION OF EXEMPLARY EMBODIMENTS OF THE PRESENT INVENTION

Figure 1:
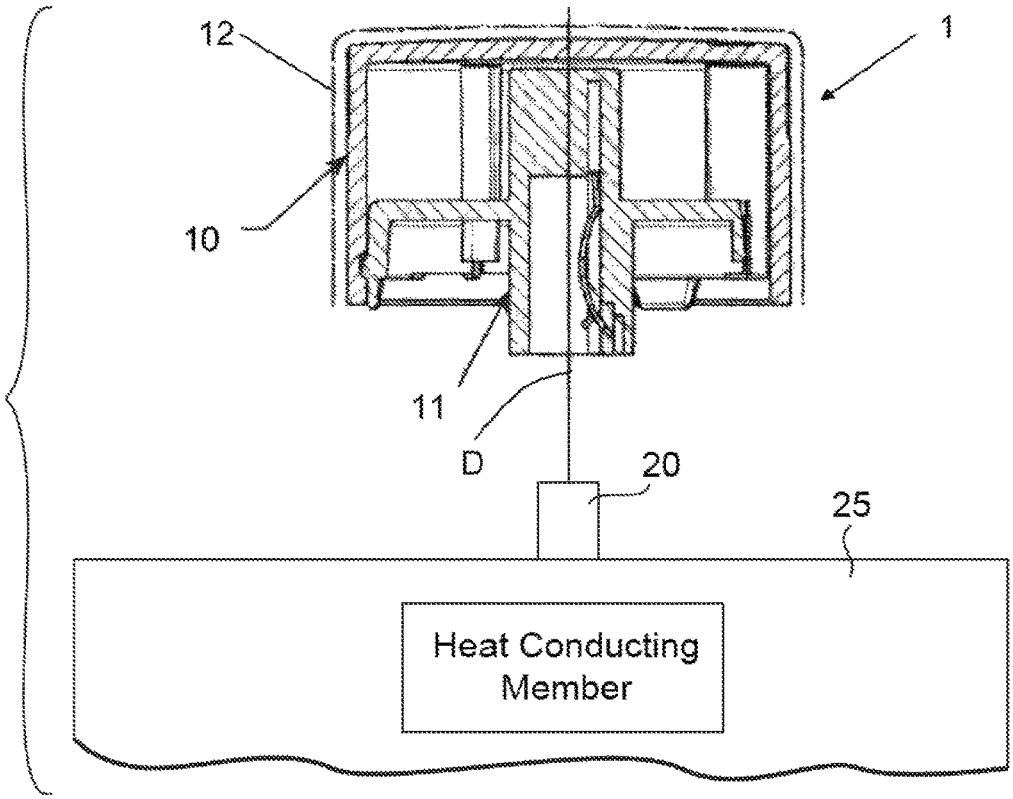
FIG. 1 shows a schematic sectional view of an operating element according to one embodiment of the present invention.
Figure 2:
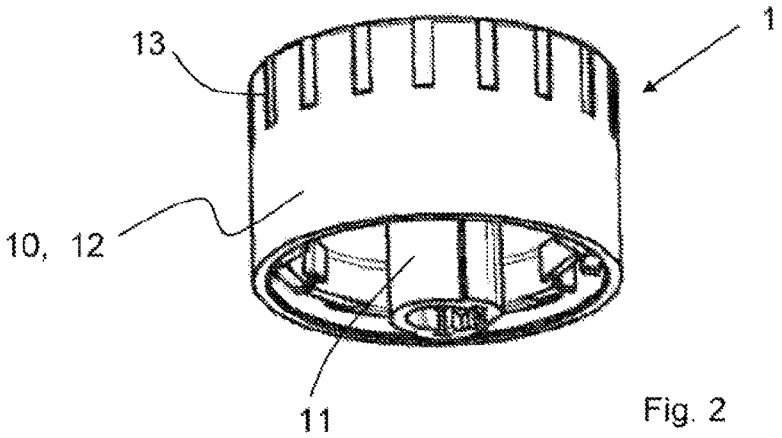
FIG. 2 shows a schematic, perspective view from below of the operating element according to FIG. 1.

FIG. 1 shows a schematic sectional view of an embodiment of an inventive operating element 1. In the illustrated embodiment it consists of a main body 10 and an axle part 11. The main body 10 is provided with a coating 12 on its outer face. Although the main body 10 and axle part 11 are shown as separate components in the illustrated embodiment, it is within the scope of the invention for them to form an integral, in other words single, component.

In the illustrated embodiment the operating element 1 is a rotationally symmetrical operating knob that can be rotated about the axis of rotation D of the axle part 11. The operating knob 1 is closed off at one axial end by a cover, which is part of the main body 10 in the illustrated embodiment. Provided at the opposing axial end is the axle part 11, by way of which the operating element 1 can be connected to other elements, for example an actuation axle 20 of a domestic appliance 25. The main body 10 is provided with a coating 12 on the outer periphery of the lateral surface of the main body 10 and on the axial end closed off by the cover. Grooves 13 are also incorporated on the outer periphery of the operating knob 1 at the closed end to facilitate rotation of the operating knob 1 for the user.

Advantages of the present invention include a superior appearance, for example in the manner of brushed stainless steel. An inventive operating element, in particular an inventive operating knob, also has a cool touch effect. Higher operating temperatures are also permissible with the inventive operating element than with a purely metal knob.

The invention claimed is:

1. An operating element for a domestic appliance, said operating element comprising a main body made of a material comprised of plastic and a filler admixed to the plastic, said filler having a thermal conductivity which is higher than a thermal conductivity of the plastic, said material of the main body having a thermal conductivity of 1 to 20 W/mK.

2. The operating element of claim 1, wherein the filler is present in the material of the main body at a proportion by volume which is less than 70%.

3. The operating element of claim 1, wherein the filler is present in the material of the main body at a proportion by volume which is less than 50%.

4. A domestic appliance, comprising at least one operating element including a main body made of a material comprised of plastic and a filler admixed to the plastic, said filler having a thermal conductivity which is higher than a thermal conductivity of the plastic, wherein the material of the main body has a thermal conductivity of 1 to 20 W/mK.

5. The domestic appliance of claim 4, wherein the filler is present in the material of the main body at a proportion by volume which is less than 70%.

6. The domestic appliance of claim 4, wherein the filler is present in the material of the main body at a proportion by volume which is less than 50%.

7. A domestic appliance, comprising:

a heat conducting member; and at least one operating element to control the heat conducting member, the operating element comprising a main body configured to be directly touched by a user to apply a force to actuate the operating element, the main body comprising a material with a plastic and a filler admixed to the plastic, said filler having a thermal conductivity which is higher than a thermal conductivity of the plastic thereby providing a cool metal sensation to the skin of the user when the main body is touched by the user, wherein the material of the main body has a thermal conductivity of 1 to 20 W/mK.

8. An operating element for a domestic appliance, said operating element comprising a main body made of a material comprised of plastic and a filler admixed to the plastic, said filler having a thermal conductivity which is higher than a thermal conductivity of the plastic, wherein the filler is a metal filler, the metal filler includes powdered copper, aluminum or stainless steel, and the metal filler is present in the material of the main body at a proportion by volume which is less than 70%.

* * * * *